United States Patent [19]

Emmott

[11] Patent Number: 4,775,095

[45] Date of Patent: Oct. 4, 1988

[54] REMAILABLE ENVELOPE

[76] Inventor: Gary G. Emmott, P.O. Box 7645, Houston, Tex. 77007

[21] Appl. No.: 558

[22] Filed: Jan. 5, 1987

[51] Int. Cl.[4] ..... B65D 27/06

[52] U.S. Cl. ..... 229/73; 206/610

[58] Field of Search ..... 229/73; 206/610

[56] References Cited

U.S. PATENT DOCUMENTS

| | | | |
|---|---|---|---|
| 702,100 | 6/1902 | Keller . | |
| 886,449 | 5/1908 | West | 229/73 |
| 1,142,349 | 6/1915 | Merrill . | |
| 1,803,348 | 5/1931 | Pasurka . | |
| 1,951,955 | 3/1934 | Wilde | 229/69 |
| 1,957,704 | 5/1934 | Drachman | 229/73 |
| 2,012,075 | 8/1935 | Adams | 229/73 |
| 2,527,925 | 10/1950 | Frampton | 229/73 |
| 2,931,559 | 4/1960 | Hilliard | 229/73 |
| 3,062,431 | 11/1962 | Rabenold | 229/73 |
| 3,111,257 | 11/1963 | Peach | 229/73 |
| 3,152,751 | 10/1964 | Hiersteiner | 229/73 |
| 3,261,623 | 7/1966 | Kiedrowski | 229/73 |
| 3,270,948 | 9/1966 | Donovan | 229/73 |
| 3,379,363 | 4/1968 | Sutphen, Jr. | 229/85 |
| 3,411,699 | 11/1968 | Pine et al. | 229/69 |
| 3,498,528 | 3/1970 | Klein | 229/73 |
| 3,554,438 | 1/1971 | Van Malderghem | 229/69 |
| 3,558,040 | 1/1971 | Kruegel | 229/73 |
| 3,747,837 | 7/1973 | Wilson | 229/73 |
| 3,854,654 | 12/1974 | Van Malderghem | 229/69 |
| 3,874,582 | 4/1975 | Wang | 229/85 |
| 3,952,942 | 4/1976 | O'Leary | 229/69 |
| 3,982,689 | 9/1976 | Retrum | 229/73 |
| 4,180,168 | 12/1979 | Hiersteiner | 206/626 |
| 4,190,162 | 2/1980 | Buescher | 206/625 |
| 4,308,987 | 1/1982 | Solomon | 229/73 |
| 4,334,618 | 6/1982 | Buescher | 206/623 |
| 4,403,696 | 9/1983 | Newell . | |
| 4,461,661 | 7/1984 | Fabel | 229/73 |

FOREIGN PATENT DOCUMENTS

| | | | |
|---|---|---|---|
| 8002827 | 12/1980 | Int'l Pat. Institute | 206/611 |
| 26331 | 12/1903 | United Kingdom | 229/73 |
| 2101528 | 1/1983 | United Kingdom | 229/73 |

*Primary Examiner*—Stephen P. Garbe

*Attorney, Agent, or Firm*—John S. Egbert

[57] ABSTRACT

An improved inside side seam envelope, the improvement comprising a first perforation formed on a face of the envelope, a second perforation formed on the same face as the first perforation and being parallel to the first perforation, and an indentation formed on the opposite face of the envelope and extending inwardly from an edge of the envelope. The first perforation is linear and extends across a face of the envelope. The first and second perforations define a detachable section on the face of the envelope. The indentation extends from an edge that is perpendicular to the first and second perforations. The indentation exposes a portion of the detachable section to the opposite face of the envelope. The second perforation is formed at the edge of the envelope adjacent to and parallel to the first perforation. The indentation extends along the opposite face from a location adjacent the first perforation to the edge of the envelope corresponding to the second perforation.

18 Claims, 7 Drawing Sheets

REMAILABLE ENVELOPE

TECHNICAL FIELD

This invention relates to envelopes and more particularly to envelopes suitable for reuse after the first mailing by detaching selected portions of the original envelope prior to the second mailing.

BACKGROUND ART

Providing a second self-addressed envelope within a first envelope submitted to the addressee by the sender for purposes of paying a bill or receiving requested information by return mail in the enclosed envelope is a common business practice. The cost of manufacturing the enclosed or second envelope is an additional expense that must be borne by the sender or passed on by the customer in the form of higher prices. Furthermore, clerical personnel are required to expend considerable time and effort in completing the task of inserting the second envelope within the first envelope to be mailed to the addressee. Once the addressee receives the envelope from the sender, there exists the possibility that the addressee will overlook the enclosed envelope and subsequently dispose of it together with the first envelope. Consequently, the effort and expense exerted by the sendere in providing the addressee with a second envelope for return mailing is wasted. Also, the first envelope, once it is received and opened by the addressee, is no longer usable and becomes a waste item thereby presenting a disposal and litter problem.

Envelopes that can be snapped open are desirable because of the case with which they are opened. In the case of advertising material, for example, such easy opening envelopes encourage the receiver to open them. Often times, however snap-open envelopes do not work as well as originally intended. Snap-open envelopes can sometimes be misunderstood by the user. Frequently, the user will not read the instructions provided on the envelope. There is usually no readily available intrinsically informative information available as to how to properly open the envelope. Rather than reading directions, the user will open the envelope in typical fashion. Many times, snap-open envelopes do not snap open properly and will leave the user with a "unusable" reusable envelope.

Exemplary efforts to provide envelopes and mailing devices for multiple use are illustrated in several prior-art patents. U.S. Pat. No. 4,334,618 describes a snap-open envelope in which the opposed ends are pulled apart to provide a portion which serves as an envelope and which has an end closure flap wherein instructions for use or notification can be applied to the flap and readily seen upon opening the original envelope. U.S. Pat. No. 3,498,528 describes a remailable envelope having a first panel with a gummed top flap narrower than the width of the envelope and another panel having a sealing flap which folds over onto the top flap and has adhesive spots thereon for securing the sealing flap to the exposed side areas. U.S. Pat. No. 4,403,696 describes a pre-stuffed mailing envelope that has a removable tear strip at one envelope end. U.S. Pat. No. 3,874,582 describes and envelope having a detachable top flap.

It is an object of the present invention to provide a reusable envelope that provides a tab portion for the easy removal of the detachable section.

It is another object of the present invention to provide a reusable envelope that will cover the original stamping when being remailed.

It is a further object of the present invention to provide a reusable envelope that is easy to use and relatively easy to manufacture.

These and other objects and advantages of the present invention will become apparent from a reading of the attached specification and appended claims.

DISCLOSURE OF THE INVENTION

The present invention is an improved inside side seam envelope, the improvement comprises a first perforation formed on a face of the envelope, a second perforation formed on the same face of the envelope as the first perforation and parallel to the first perforations, and an indentation formed on the opposite face of the envelope so as to extend inwardly from an edge of the envelope generally adjacent the first and second perforations. The first perforation is linear and extends across a face of the envelope. The first and second perforations define a detachable section on the face of the envelope. The indentation extends inwardly from the edge of the envelope perpendicular to the first and second perforations. This indentation is formed so as to expose a portion of the detachable section from the opposite face of the envelope.

The second perforation is formed at the edge of the envelope adjacent to and perpendicular to the first perforation. The indentation extends along the opposite face of the envelope from a location adjacent to the first perforation to the edge of the envelope corresponding to the second perforation. This indentation begins at a point on the edge of the envelope and extends beyond the end of the first perforation.

A remoisten glue section is affixed to the inner side of the opposite face of the envelope. This remoisten glue section extends linearly adjacent to the edge of the opposite face corresponding to the second perforation. This linear strip of remoisten glue extends along the upper edge of the inner side of the opposite face of the envelope and extends from the indentation to the edge of the envelope opposite the indentation. A score line extends across the opposite face of the envelope. The score line is linear and corresponds to the location of the first perforation. In particular, the score line extends across the length of the opposite face of the envelope and parallel to the top edge of the envelope.

The first perforation extends across the length of the envelope. The second perforation is located at the upper edge of the envelope. The indentation is formed at a corner of the envelope. In particular, the first perforation extends across the front face of the envelope and the indentation is formed at the back face of the envelope.

In an alternative embodiment of the present invention, the detachable section has, at least, one end flap. This end flap is folded inwardly from one end of the detachable section. The end flap is juxtaposed between the faces of the envelope. This end flap has a length longer than the distance that the indentation extends inwardly. This end flap has a generally U-shape. This detachable section may also have a second end flap folded inwardly from the other end of the detachable section. This second end flap is also juxtaposed between the faces of the envelope.

In a still further embodiment of the present invention, the present invention has a perforated section that is formed adjacent to the indentation or, otherwise phrased, defines the indentation. This perforated section extends from the indentation so as to cover the exposed portion of the detachable section and extends so as to be flush with the edge of the envelope.

BEST MODE FOR CARRYING OUT THE INVENTION

Figure 1:
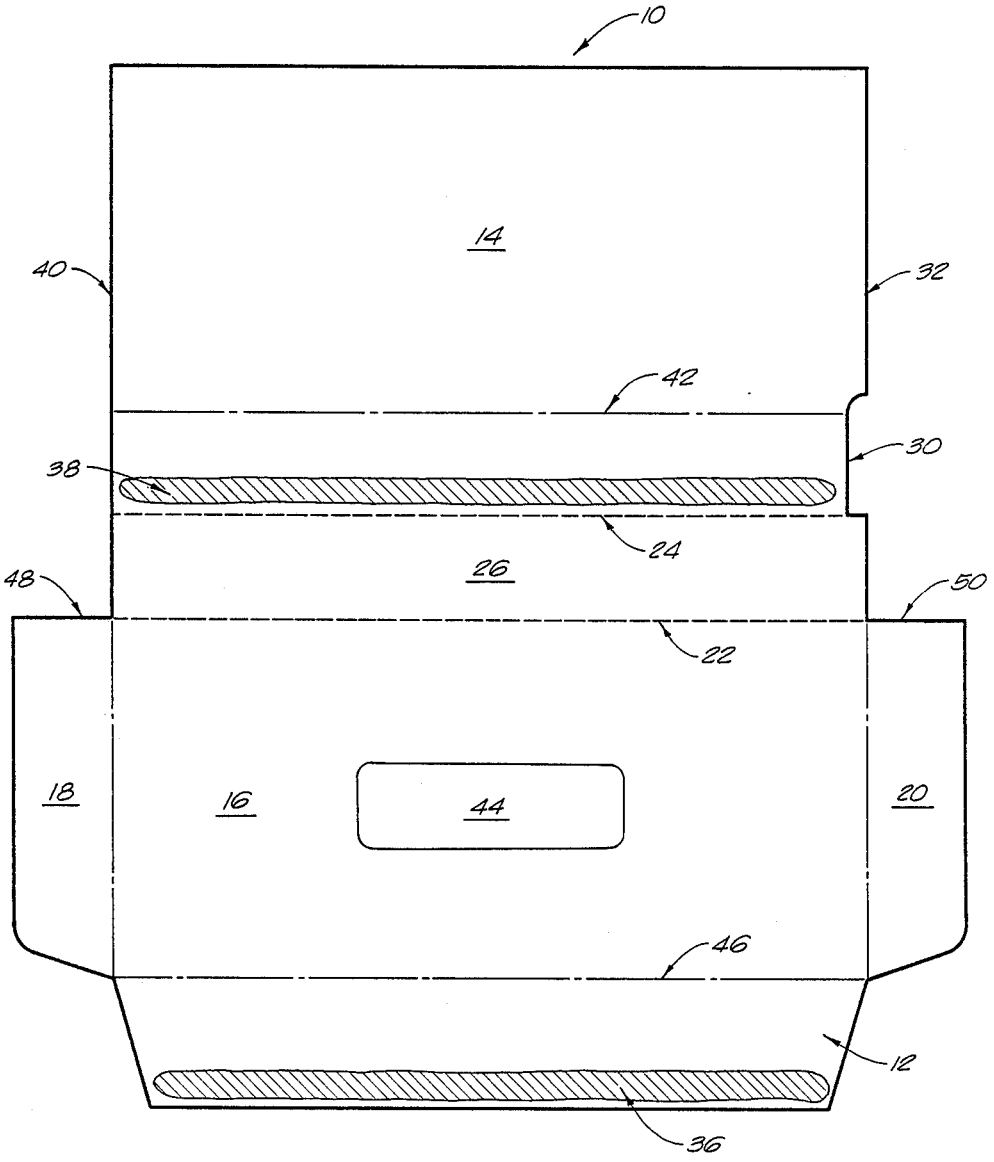
FIG. 1 shows the rearward view of the unassembled remailable envelope in accordance with the preferred embodiment of the present invention.

Referring to FIG. 1 there is shown at 10, the improved inside side seam envelope in accordance with the preferred embodiment of the present invention. FIG. 1 shows envelope 10 in its unassembled state. In other words, the illustration of FIG. 1 shows the envelope as it would appear after being die cut and after having glue applied.

The envelope 10 is of the type having a trapezoidal-shaped flap 12 foldable at the bottom of the envelope. FIG. 1 shows envelope 10 as having back face 14, front face 16, and end closure panels 18 and 20. A first perforation 22 is formed on front face 16 of envelope 10. First perforation 22 is linear and extends across the face of the envelope 10. As used herein, the term "face" includes the edges of each face. Second perforation 24 is linear and parallel to the first perforation 22. The first perforation 22 and the second perforation 24 define a detachable section 26 on face 16 of envelope 10.

Second perforation 24 is formed at an area corresponding to the edge of envelope 10 adjacent to and parallel to the first perforation. In particular, the second peforation 24 is locted at the top edge of envelope 10.

An indentation 30 is formed on the back face 14 of envelope 10. This indentation extends inwardly from edge 32 of envelope 10. Edge 32 is perpendicular to first perforation 22 and second perforation 24. Indentation 30 is formed so as to expose a portion of the detachable section 26 when the envelope is assembled. This indentation 30 extends along face 14 to the edge 24 of envelope 10. In the assembled state, indentation 30 will occur at a corner of the envelope.

As can be seen from FIG. 1, flap 12 has a remoisten glue section 36. Remoisten glue section 36 is a ordinary type of remoistening glue that it used to seal standard envelopes. It can be also seen that a remoisten glue section 38 is affixed to the back face 14 of envelope 10. This remoisten glue section 38 extends linearly across face 14 and generally adjacent the edge corresponding to the second perforation 24. In the assembled state, this remoisten glue section 38 will extend along the upper edge on the linear side of the face 14 of envelope 10. This remoisten glue section extends from indentation 30 to the edge 40 of envelope 10. A score line 42 extends along the back face 14 of envelope 10 and is parallel to first perforation 22 and second perforation 24. In the assembled state, score line 42 will be aligned with first perforation 22.

A window 44 opens through envelope 10. Window 44 allows communications and correspondence to be placed inside the envelope and to be exposed exterior of the envelope. A clear plastic or cellophane material may be include in window 44, if necessary.

End closure panel 18 and 20 extend outwardly from sides 32 and 40 of envelope 10. End closure panel 18 and 20 extend from the score line 46 of flap 12 to the first perforation 22. The edges 48 and 50 of end closure panels 18 and 20, respectively, are aligned with the first perforation.

Figure 2:
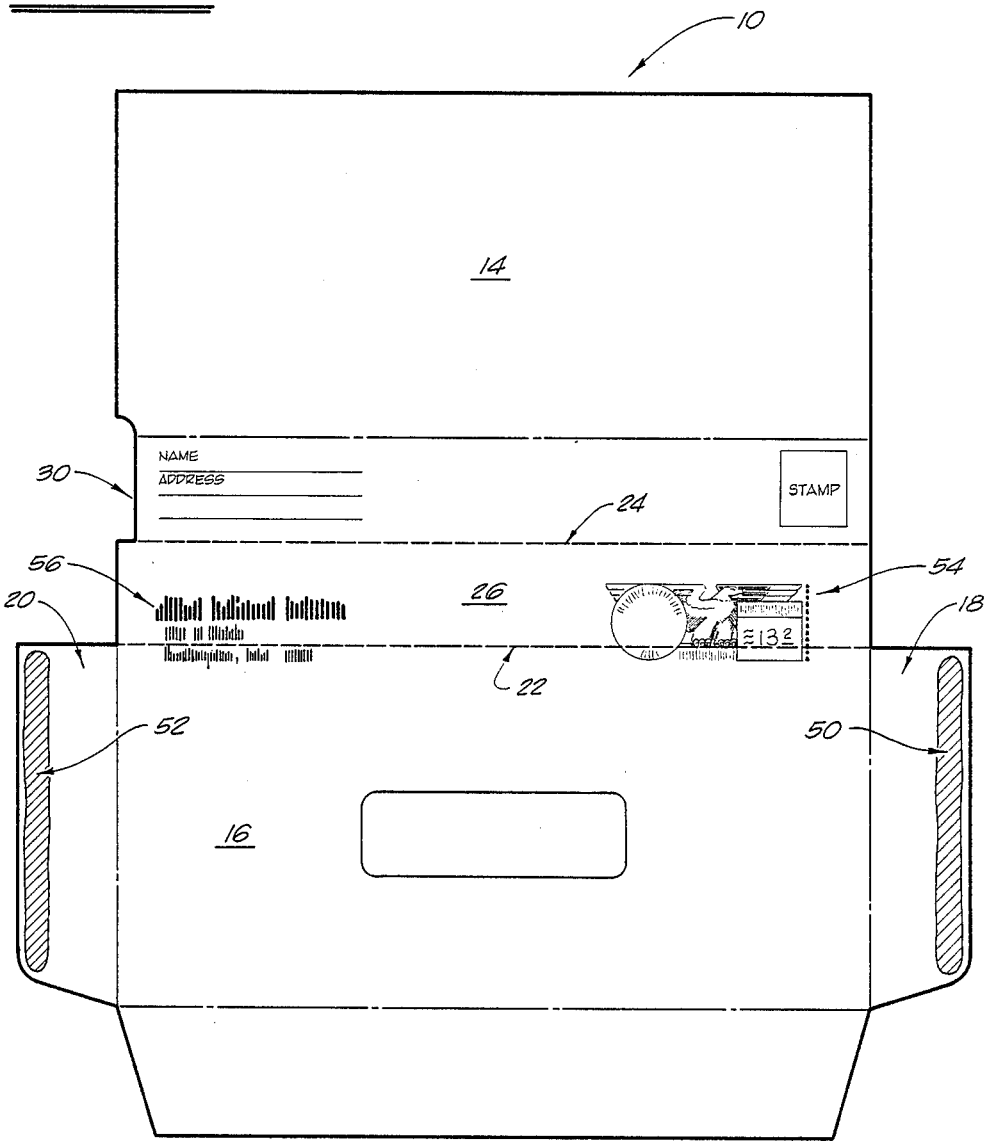
FIG. 2 is a forward view of the unassembled remailable envelope in accordance with the preferred embodiment of the present invention.

FIG. 2 shows the frontal view of the unassembled envelope 10. As can be seen from this frontal view, a permanent glue strip 50 extends across end closure panel 18. Similary, a permanent glue strip 52 extends across end closure panel 20. In the assembled condition of the envelope, these permanent glue strips 50 and 52 will engage the inner side of back face 14 of envelope 10. This configuration of glue and this arrangement is typical of inside side seam envelopes. In other words, the end closure panels 18 an d20 are sealed inwardly of the envelope. With this type of envelope, there is much less risk of damage or tearing in the process of mail sorting.

In FIG. 2, first perforation 22 extends across the length of face 16 of envelope 10. This first perforation 22 extends through stamp area 54 and return address area 56 such that less than one-half of the width of the stamp area 54 is shown on the lower side of first perforation 22. The second perforation 24 is located at the top edge of the front face 16 of envelope 10.

Figure 3:
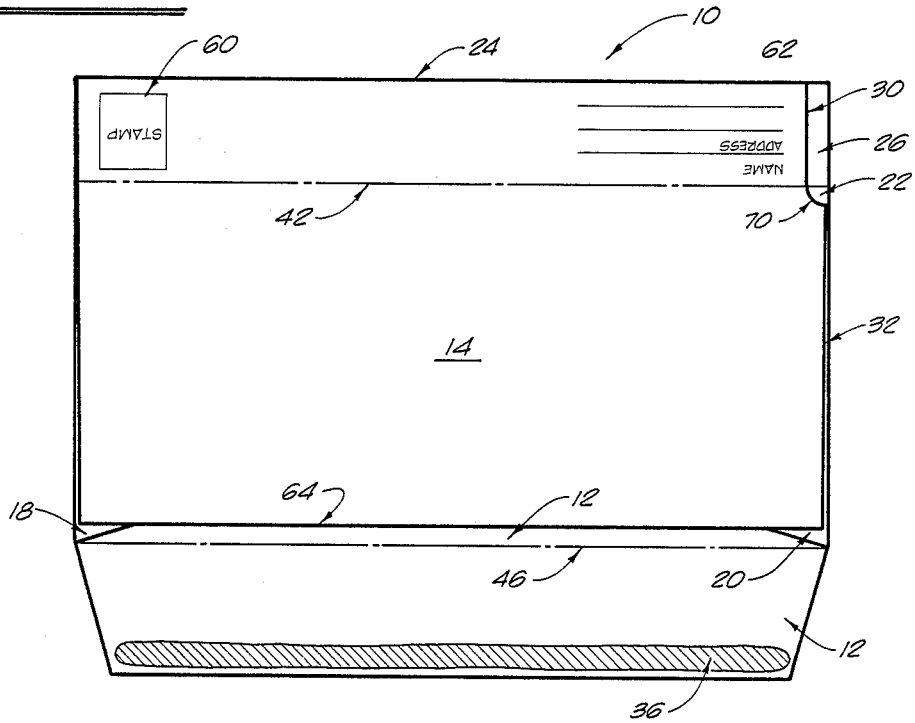
FIG. 3 is a rearward view of the assembled envelope of the present invention.

FIG. 3 shows the rearward view of the assembled version of the envelope 10. FIG. 3 shows the back face 14 of envelope 10. Second perforation 24 is at the top edge of envelope 10. Score line 42 extends across this back face 14. The stamp location symbol 60 is located between the score line 42 and the top edge 24. The return address symbol 62 is similarly located between score line 42 and top edge 24.

End closure panels 18 and 20 are overlapped by and affixed to back face 14. A portion of these end closure panels 18 and 20 extends outwardly beyond the end 64 of back face 14. Top flap 12 extends outwardly from score line 46. In use, material will be inserted into the area between the inner side of front face 12 and the inner side of back face 14. After the mailing material is inserted, the remoisten glue 36 is moistened and sealed against the outer surface of back face 14. Importantly, it can be seen that indentation 30 extends inwardly from edge 32 of envelope 10. Indentation 30 is formed so as to expose a portion of detachable section 26 from the back face 14 of envelope 10. The exposed portion 26 can be considered a tab that allows the opening of envelope 10. The indentation 30 extends from top edge 24 downwardly, perpendicular to the perforation 24. This indentation 30 extends beyond the first perforation 22. After indentation 30 passes first perforation 22, indentation 30 has curvature 70 extending to the edge 32 of envelope 10.

Figure 4:
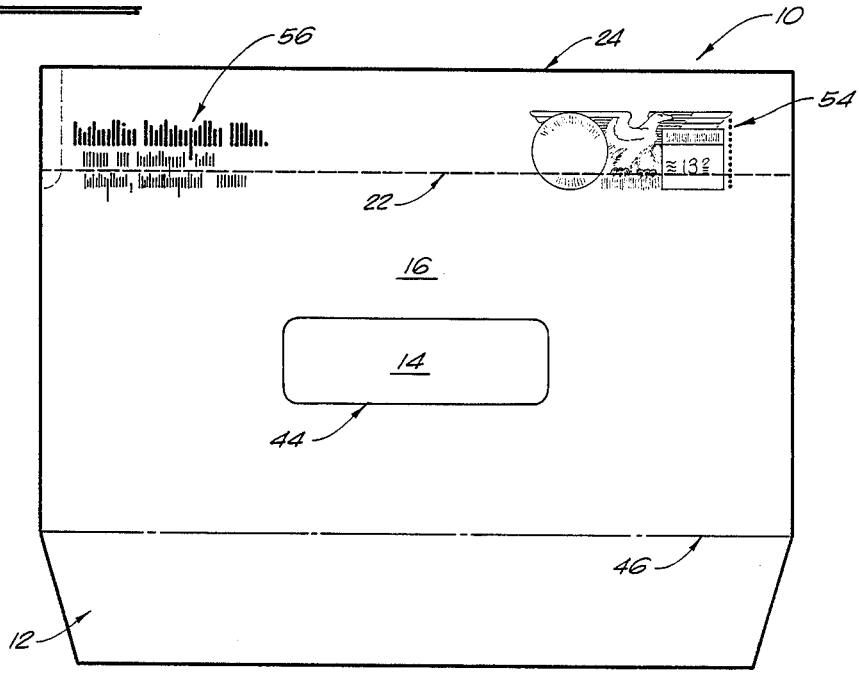
FIG. 4 is a frontal view of the assembled envelope of the present invention.

FIG. 4 shows a frontal view of the assembled envelope 10. This frontal view has stamp area 54 and return address area 56 visible on front face 16 of envelope 10. The back face 14 of envelope 10 can be seen through window 44. The top flap 12 opens downwardly. The first perforation 22 and the second perforation 24 extend across the length of envelope 10 in parallel fashion.

Figure 5:
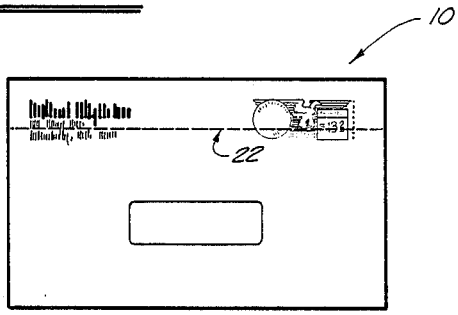
FIGS. 5–9 show, sequentially, the steps for removing the detachable section of the remailable envelope of the present invention.
Figure 7:
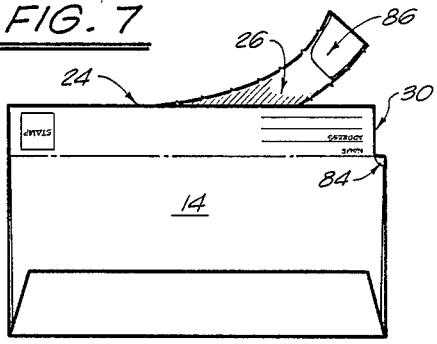
Figure 8:
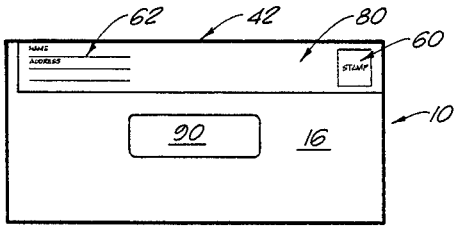
Figure 9:
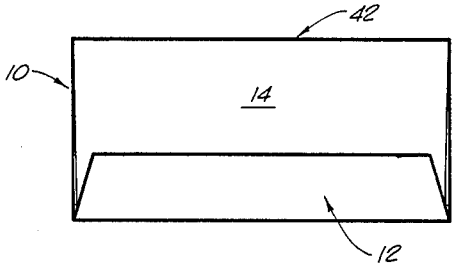

FIGS. 5–9 show the operation and use of the remailable envelope 10 of the present invention. In particular, these FIGS. 5 9 show the opening of the envelope for removal of mailed material and they show the closing of the envelope to "remail" the material.

FIG. 5 shows the envelope 10 having top flap 12 sealed against the back face 14. The envelope of FIG. 5 appears identical to other forms of mailed correspondence. The only difference from this frontal view is the first perforation 22 extending across the face of the envelope. The quantity of this perforation 22 should be of the quality that cannot be separated or torn by sorting machines in post offices. It should also have a character and quality that would prevent inadvertent and accidental separating.

Figure 6:
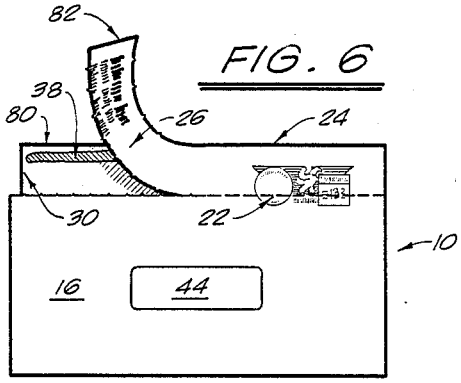

FIG. 6 shows the detachable section 26 being separated along perforation 22 from the front face 16 of envelope 10. This detachable section is initially pulled at the area of indentation 30. As detachable section 26 is pulled upwardly and separated along first perforation 22 and second perforation 24, the remaining flap 80 is exposed. Continued pulling of detachable section 26 at end 82 will cause the detachable section 26 to completely separate. After detachable section 26 is separated from envelope 10, the correspondence contained within the envelope may be removed.

FIG. 7 shows the rearward view of the operation indicated in FIG. 6. In FIG. 7, the detachable section 26 is initially pulled at the area defined by indentation 30. Since the indentation has a length wider than the distance between the first perforation 22 and the second perforation 24, a small corner 84 of the front face 16 will be exposed. The curved area 86, shown in FIG. 7, is part of an alternative embodiment of the present invention, to be described hereinafter.

After the correspondence is removed from the originally mailed envelope 10, the return correspondence may be placed into the opened envelope indicated by FIGS. 6 and 7. In FIG. 8, the now-exposed back flap 80 is folded along score line 42 over the front face 16 of envelope 10. The return correspondence may have a return address 90 that is exposed through window 44. A stamp 60 may be placed on the indicated symbol and the return address 62 may also be placed in the indicated area. The remoisten glue 38 may be moistened so as to seal flap 80 to the front face 16 of envelope 10. The envelope indicated in FIG. 8 is now ready for remailing.

FIG. 9 shows the back view of the envelope shown in FIG. 8. The width of the remailed envelope is smaller than the width of the originally mailed envelope. The original score line 42 forms the top edge of the remail envelope. The bottom flap 12 remains sealed.

Figure 10:
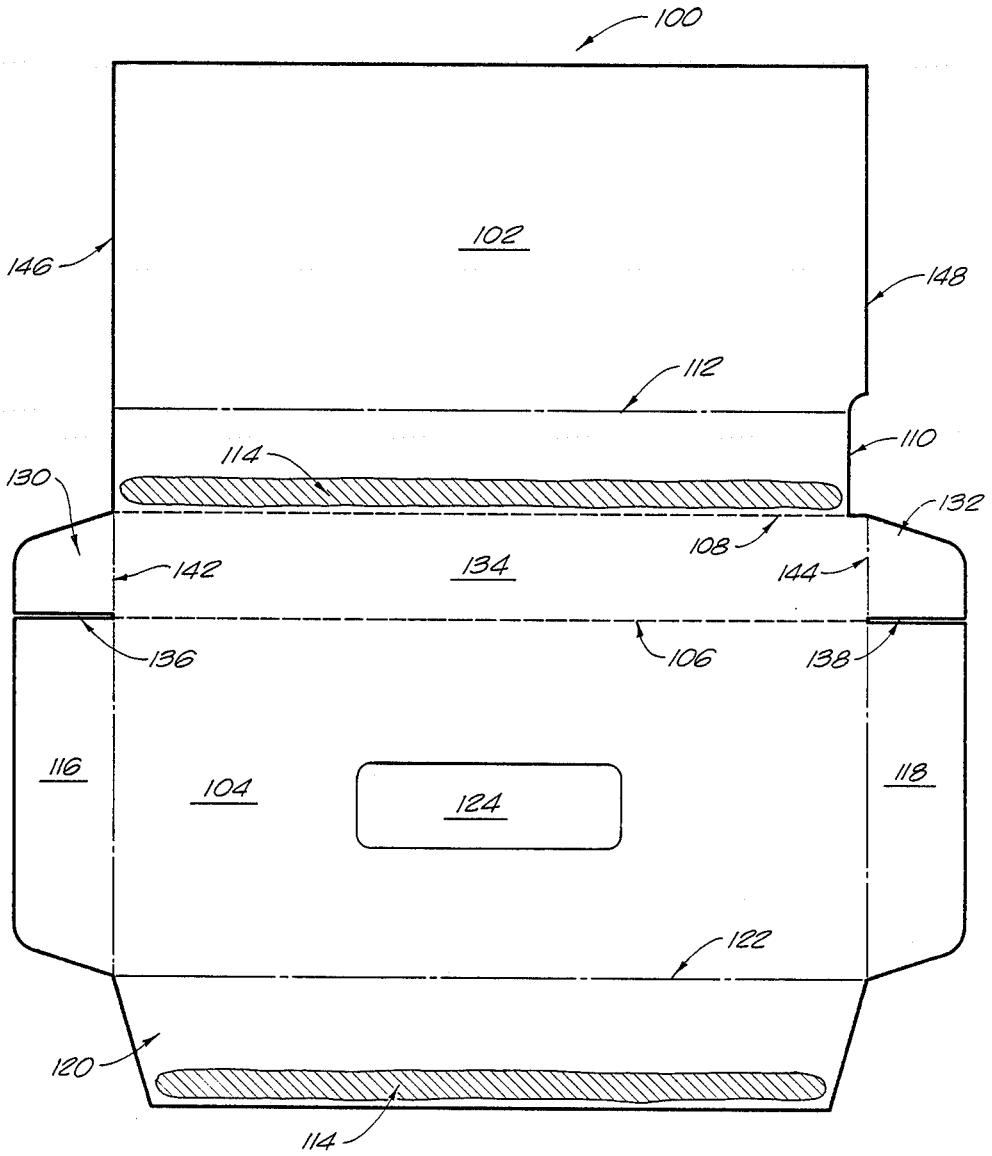
FIG. 10 is a rearward view of the unassembled envelope of an alternative embodiment of the present invention.

FIG. 10 shows an alternative embodiment 100 of the envelope of the present invention. This embodiment 100 has a virtuall identical appearance to that of the preferred embodiment 10 of the present invention. Envelope 100 has back face 102, front face 104, first perforation 106, second perforation 108, indentation 110, score line 112, remoisten glue 114, end closure panels 116 and 118, top flap 120, top flap score line 122, and window 124. The particular and detailed description of the arrangement of the separate aspects of envelope embodiment 100 are described hereinbefore in connection with the preferred embodiment of the present invention.

The alternative embodiment 100 includes end flaps 130 and 132. End flaps 130 and 132 extend from each end of the detachable section 134 between first perforation 106 and second perforation 108. End flap 130 is adjacent to end closure panel 116. End flap 130 is separated at space 136 from end closure panel 116. Similarly, end flap 132 is separated at space 138 from end closure panel 118. Score lines 142 and 144 extend along the edges 146 and 148 of envelope 100. The score lines 142 and 144 allow end flaps 130 and 132 to be folded inwardly. These end flaps 130 and 132 have a length that is longer than the width of indentation 110. In other words, it is desirable for the end flap 132 to extend inwardly beyond the indentation 110. Each of these end flaps 130 and 132 has a roughly U-shaped configuration.

Figure 11:
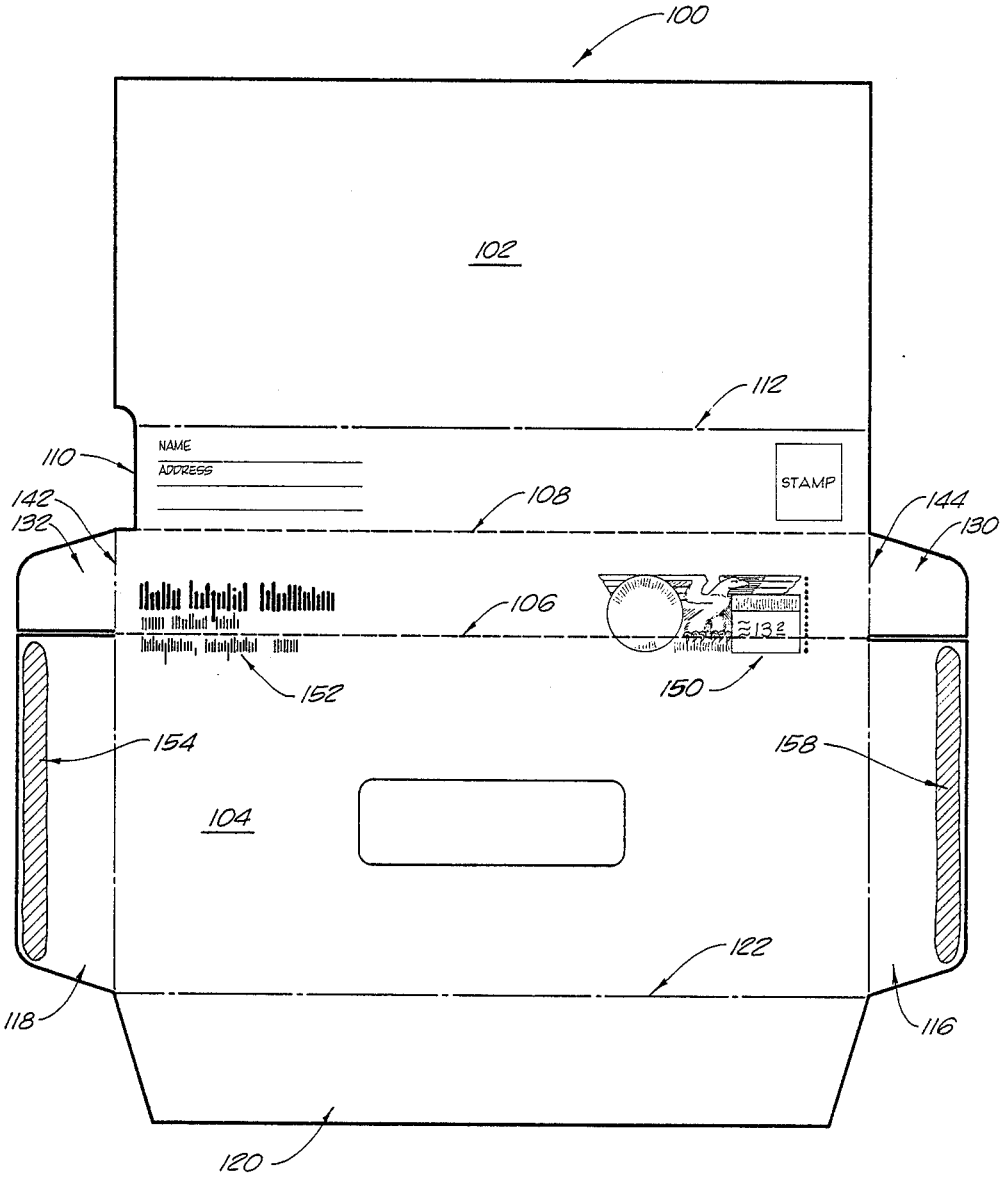
FIG. 11 is a forward view of the unassembled envelope of the alternative embodiment of the present invention.

FIG. 11 shows the frontal view of the embodiment 100 and, in particular, the end flaps 130 and 132. As can be seen, end flaps 130 and 132 extend outwardly from the areas adjacent the stamp area 150 and the return address area 152. It can also be seen that the permanent glue strips 154 and 158 on end closure panels 118 and 116 do not extend to the end flaps 130 and 132.

Figure 12:
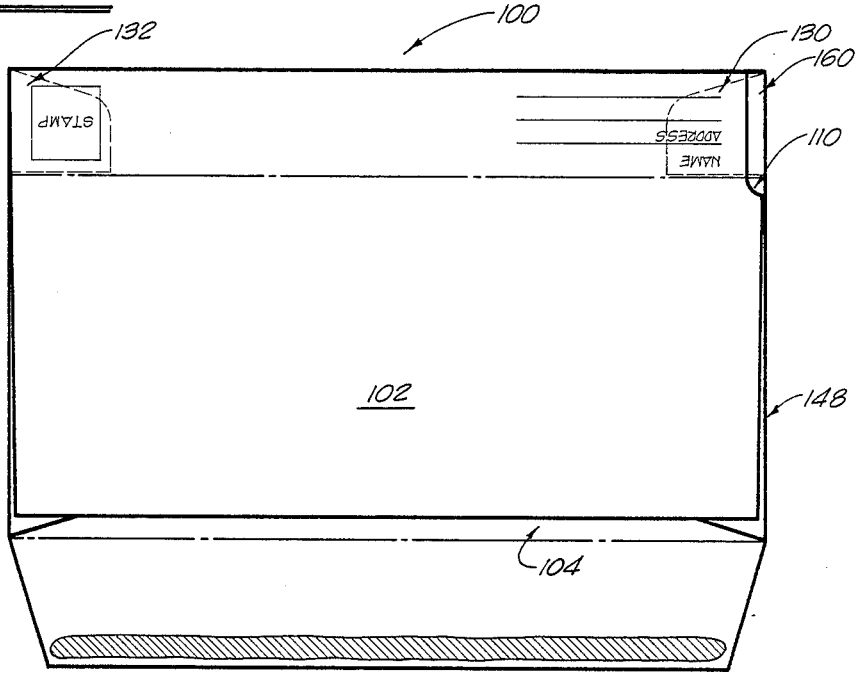
FIG. 12 is a rearward view of the assembled envelope of the alternative embodiment of the present invention.

FIG. 12 shows the configuration of the assembled envelope 100. It can be seen that, by the dotted lines, the end flaps 130 and 132 are juxtaposed between the front face 104 and the back face 102 of envelope 100. It can be seen that indentation 110 extends over the end flap 130.

Figure 13:
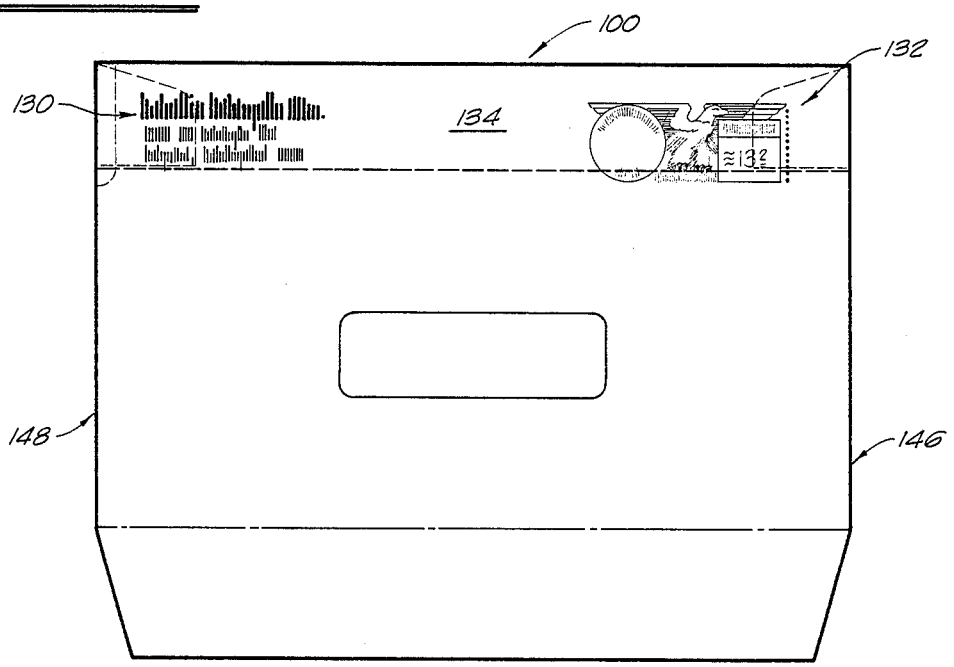
FIG. 13 is a forward view of the assembled envelope of the alternative embodiment of the present invention.

In FIG. 13, it can similarly be seen that the end flaps 130 and 132 are folded inwardly from the sides 146 and 148 of envelope 100.

The purpoose of the end flap 130 is to enhance the confidentiality of the enclosed material. In the preferred embodiment of the present invention, it would be possible to look inside the envelope from the open area at the indentation. Importantly, however, when the end flap 130 is folded inwardly, it becomes very difficult to examine the contents of the envelope from the outside. This is even further enhanced when the correspondence is placed on the side of the end flap opposite the indentation. The inclusion of the end flap has no effect on the style of opening. As can be seen in FIG. 7, the end flap 86 remains folded and adjacent the detachable section 26.

FIG. 12 shows a further, alternative configuration of the present invention. As illustrated in FIG. 12, the indentation 110 is defined by a preferred section 160. During the origianl die cutting of the paper, a perforation is made instead of the previously-described indentation. This perforated section 160 defines the indentation itself. This perforated section 160 extends so as to cover the exposed portion of the detachable section 134. Perforated section 160 also extends so as to be flush with edge 148 of envelope 100.

When it become necessary to open the envelope having the perforated section 160, it is necessary to initially tear open this perforated section 160. After perforated section 160 is removed, then the envelope can be opened by the previously described method. The perforated section 160 is used for the purpose of enhancing the visual appearance of the envelope, to further enhance the security of the envelope, and to prevent the unauthorized observation of the contents of the envelope.

The present invention, in its various embodiments, offers a number of advantages over prior art reusable or remailable envelopes. Most importantly, the indentation area on the back face allows the easy recognition of the manner in which to open the envelope. This style of opening the envelope results in less failures. The configuration of the present envelope allows the envelope to be reused after covering the previously cancelled stamp from the original mailing. The envelope of the present invention can easily be remailed because return addresses are retained on the envelope, the envelope can be easily resealed, and the proper addressee information can appear in the window of the envelope.

The envelope of the present invention can be manufactured at less expense and in a faster fashion than other remailable-style envelopes. Since no additional "tabbing" features need to be formed, less die cutting machinery is required. There are fewer loose edges and other portions that could jam in sorting machines or other postal processing. The inside side seam envelope is preferable because of its more cohesive appearance. The alternative embodiment of the present invention, employing the end flap, enhances the security and the confidentiality of the communications contained therein.

The foregoing disclosure and description of the invention is illustrative and explanatory thereof, and various changes in the size, shape and materials, as well as in the details of the illustrated construction, may be made within the scope of the appended claims without departing from the spirit of the invention. This invention should only be limited by the appended claims and their legal equivalents.

I claim:

1. An improved inside side seam envelope, the improvement comprising:

a first perforation formed on the front surface of said envelope, said first perforation being linear and extending across the length of said envelope;

a second perforation formed on said envelope on the same surface as said first perforation, said second perforation being parallel to said first perforation, said first and second perforations defining a detachable section on said surface, said detachable section being free of adhesive material; and an indentation formed on the back surface of said envelope, said indentation extending inwardly from an edge of said envelope, said edge being perpendicular to said first and second perforations, said indentation formed so as to expose a portion of said detachable section to said back surface of said envelope.

2. The improvement of claim 1, said second perforation formed at the edge of said envelope adjacent to and parallel to said first perforation.

3. The envelope of claim 2, said indentation extending along said back surface from a location adjacend said first perforation to the edge of said envelope corresponding to said second perforation.

4. The improvement of claim 3, said indentation beginning at a point on the edge of said envelope above an end of said first perforation.

5. The improvement of claim 1, said detachable section having an end flap, said end flap folded inwardly from one end of said detachable section, said end flap juxtaposed between the surfaces of said envelope.

6. The improvement of claim 5, said end flap having a length longer than the distance that said indentation extends inwardly.

7. The improvement of claim 6, said end flap having a U-shape.

8. The improvement of claim 5, said detachable section having a second end flap, said second end flap folded inwardly from the other end of said detachable section, said second end flap juxtaposed between the surfaces of said envelope.

9. The improvement of claim 1, further comprising:

a remoisten glue section affixed to the inner side of said back surfaces of said envelope, said remoisten glue section extending linearly and adjacent to the edge of said back surface coresponding to said second perforation.

10. The improvement of claim 9, said remoisten glue section comprising a linear strip extending along the upper edge on the inner side of said back surface, said remoisten glue section extending from said indentation to the edge of said envelope opposite said indentation.

11. The improvement of claim 1, said second perforation located at the upper edge of said envelope, said indentation formed at an upper corner of said envelope.

12. The improvement of claim 11, said indentation formed on the back surface of said envelope.

13. The improvement of claim 1, further comprising:

a score line extending across said back surface of said envelope, said score line being linear and corresponding to the location of said first perforation.

14. The improvement of claim 13, said score line extending across the length of said back surface and parallel to the top edge of said envelope.

15. An improved inside side seam envelope, the improvement comprising:

a first perforation formed on the front surface of said envelope, said first perforation being linear and extending across the length of said envelope;

a second perforation formed on said envelope on the same surface as said first perforation, said second perforation being parallel to said first perforation, said first and second perforations defining a detachable section on said surface, said detachable section being free of adhesive material; and a perforated section formed on the back surface of said envelope, said perforated section defining an indentation extending inwardly from an edge of said envelope, said edge being perpendicular to said first and second perforations, said perforated section being adjacent said first and second perforations and extending therebetween.

16. The improvement of claim 15, said second perforation formed at the edge of said envelope adjacent to and parallel to said first perforation, said perforated section extending along said back surface from a location adjacent said first perforation to the edge of said envelope corresponding to said second perforation.

17. The improvement of claim 15, said detachable section having an end flap, said end flap folded inwardly from one end of said detachable section, said end flap juxtaposed between the surfaces of said envelope.

18. The improvement of claim 15, said first perforation extending across the length of said envelope, said second perforation located at the upper edge of said envelope, said perforated section formed at a corner of said envelope.

* * * * *